US005761767A

United States Patent [19]

Barton

[11] Patent Number: 5,761,767

[45] Date of Patent: Jun. 9, 1998

[54] HANDLE

[76] Inventor: Thomas J. Barton, 24353 Buckland Holden Rd., Waynesfield, Ohio 45896

[21] Appl. No.: 619,314

[22] Filed: Mar. 21, 1996

[51] Int. Cl.[6] ..... B25G 1/10

[52] U.S. Cl. ..... 16/114 R; 16/110 R

[58] Field of Search ..... 16/114 R, 111 R, 16/125, 126, 127, DIG. 12; D8/101, 303; 482/106, 108, 139

[56] References Cited

U.S. PATENT DOCUMENTS

| | | | |
|---|---|---|---|
| 90,305 | 5/1869 | Reilly . | |
| D. 122,704 | 9/1940 | Wickbergh . | |
| D. 125,602 | 3/1941 | Wheeler et al. . | |
| D. 230,960 | 3/1974 | Peroni . | |
| D. 241,806 | 10/1976 | Johnson | D8/303 |
| D. 245,062 | 7/1977 | Grame . | |
| D. 248,616 | 7/1978 | Johnson | D8/303 |
| D. 267,147 | 12/1982 | Jannard | D8/303 |
| D. 279,254 | 6/1985 | Smith et al. . | |
| D. 368,636 | 4/1996 | Planka et al. . | |
| 1,691,467 | 11/1928 | Carver . | |
| 1,744,413 | 1/1930 | Peterson et al. . | |
| 3,263,588 | 8/1966 | Robinson . | |
| 3,995,650 | 12/1976 | DiVito | 16/111 R |
| 4,037,850 | 7/1977 | Haberlin . | |
| 4,522,083 | 6/1985 | Morgan . | |
| 4,599,920 | 7/1986 | Schmid | 16/DIG. 12 |
| 4,773,398 | 9/1988 | Tatom | 482/139 |
| 4,885,818 | 12/1989 | Arterbury . | |
| 5,009,416 | 4/1991 | Caruthers . | |
| 5,159,851 | 11/1992 | Rahmes . | |
| 5,299,802 | 4/1994 | Bouchet-Lassale . | |

*Primary Examiner*—Daniel W. Howell
*Assistant Examiner*—Mark Williams
*Attorney, Agent, or Firm*—Frost & Jacobs LLP

[57] ABSTRACT

A handle structure providing the user with a comfortable, natural, hook-type grip, maintaining the use's wrist in a neutral or flexed position during the performance of gripping, pulling, or lifting movements of a repetitive exercise routine or an extended work routine, to facilitate grip strength and endurance. The handle comprises a grip portion from which a fixed or adjustable support surface extends tangentially, the user's palm is engaged by the support surface preventing the hand and wrist from extending due to fatigue or slippage.

17 Claims, 11 Drawing Sheets

HANDLE

TECHNICAL FIELD

The invention relates to a unique handle structure, and more particularly to a handle structure which provides the user with a comfortable, natural grip, while maintaining the orientation of the user's wrist in a neutral or flexed position during the performance of gripping, pulling, or lifting movements.

BACKGROUND ART

The handle of the present invention has many uses, as will be apparent hereinafter. The handle of the present invention is particularly well adapted for use with weight lifting and exercise equipment where the achievement of maximum grip is of utmost importance in achieving a beneficial workout. The purpose and benefits of the handle of the present invention are easily illustrated in the field of weight training because this activity requires that a neutral or slightly flexed grip is first achieved, and then continuously maintained to facilitate maximum weight and number of repetitions for the user to achieve the desired physiological results from the exercise routine. For this reason, and for purposes of an exemplary showing, the handle will primarily be described in its application to weight lifting and exercise equipment. It will be understood by one skilled in the art that this is not intended to be a limitation of the present invention other than as set forth in the claims hereinafter. The handle of the present invention can additionally be used in applications which require the user to grip and maintain continuous control of any attached device, such as in machine operation. The handle of the present invention can be used advantageously, for example, as a carrying handle for substantially any portable device intended for manual carrying.

The use of repetitive exercise and motions in weight lifting equipment training requires an individual to exercise specific muscle groups in an effort to tone, to increase the strength and to increase the size of the targeted muscle groups. There are currently many types of devices on the market which attempt to accomplish this goal, ranging from sophisticated multi-station machines to basic free weights, bar bells, and dumbbells. During any specific training period or routine, the user of these devices, whether the movement involves pulling or holding, must first achieve a grip which will provide to the user a mechanical advantage with respect to the device being manipulated. Most of these prior art devices, regardless of the degree of their complexity, are provided with handles which are basically cylindrical, having a substantially round cross-section, which fits into the palm of the user's hand.

In the use of weight lifting equipment, grip strength and grip endurance are essential in performing the necessary actions, especially pulling movements. In the field of weight training, a pulling movement is one in which the user pulls a weight toward his or her body. Another form of pulling movement is one in which the user pulls toward his or her body one or more handles attached to a weight by one or more cables. A seated cable row is a well known example of this. There are also numerous types of pull-down machines. Yet another pulling movement is the well-known chin-up or pull-up where the user pulls the body toward a fixed object from a dead hanging position.

Another important aspect of gripping is to distinguish between squeez-type gripping and hook-type gripping. The wrist in about 30 degrees to about 40 degrees of extension is in the optimal position for squeeze type gripping.

However, in the applications to which the present invention is directed, a strong hook-type grip is more desirable than the classic squeeze grip. The mechanical advantage gained by using a hook-type grip overcomes any disadvantages normally believed to be associated with gripping in a partial state of flexion. The handles of the present invention are designed to maximize a very strong hook-type grip in contrast to the classical squeeze-type grip. The distinction here is the difference in the best grip for an axial or near axial load such as in pulling versus the power or squeeze grip used in grasping the handle of a hammer or the like.

As an example, in the above-mentioned exercise known as the seated cable row, the user is placed in a seated position on a flat surface with the feet extended to the front. Reaching forward towards the feet the user grasps a handle assembly providing two fixed bar-like cylindrical handle elements, one for each hand, which are approximately 8 inches apart and are perpendicular to the floor when held. The handle assembly is attached to one end of a cable which passes about a series of pulleys. The other end of the cable is attached to a selected weight. With the hands approximately 8 inches apart, palms facing each other, the user grasps the handles of the handle assembly by placing them in the palms of each hand. With the elbows slightly flexed and the back perpendicular to the floor, the user pulls back on the handle assembly until the hands touch the mid-section of the body. This results in a lifting of the weight attached to the cable. Thereafter, the user lowers the weight in a controlled manner, returning his body to the starting position in preparation for a sequential repetition of the same movement. This effort constitutes one "repetition" of the specific exercise. A non-stop series of such repetitions constitutes a "set".

It is typical for the user to attempt to perform four or more sets, comprising about 10 to 12 repetitions each, in a given exercise routine. The primary or target muscle group which benefits from this particular routine is the latissimus dorsi. The assisting muscles involved in this routine are the biceps (which enable the elbow to flex) and the forearm flexor muscles. Also involved are the flexor digitorum profundus and the flexor pollicis longus muscles, which enable the hands to grip the handle elements of the handle assembly. The flexor carpi radialis and the flexor carpi ulnaris, the primary wrist flexor muscles, maintain the wrists in a neutral or slightly flexed position. As the user progresses further into the exercise routine, the hand flexor muscles have a tendency to fatigue and the wrists begin to extend, thereby breaking the neutral plane. This results in the handle moving to the distal portion of the fingers, which puts the hand flexor muscles at a mechanical disadvantage, causing grip failure or the extending of excessive energy to maintain the user's grip. The handle of the present invention prevents fatigued wrist extension and maintains a powerful hook grip.

The present invention is based upon the discovery that a handle may be so shaped that it causes the user to maintain an optimum wrist position during gripping, pulling, and lifting movements. This enables the user to avoid premature grip/wrist fatigue while performing various types of work. The handle of the present invention, in its simplest form, comprises a substantially cylindrical grip portion with a substantially planar support portion extending tangentially from the grip portion. The angle formed between the support portion and the directional force should be from about 0 degrees to about 45 degrees, and preferably about 20 degrees to about 30 degrees, resulting in from about 0 degrees to about 45 degrees and preferably 20 degrees to about 30 degrees, of wrist flexion for optimal results. The user's hand grasps the handle in such a fashion that the four fingers of the hand curl around the grip portion and the palm lays flat against the support portion. The thumb may curl around the grip portion in a direction opposite the fingers, or the thumb may lie alongside the index finger, as will be explained hereinafter.

The support portion of the handle of the present invention can be applied to existing bars and handles already in use. The support portion can be affixed to a tubular member or to collars which can be mounted on existing bars or handles with a sliding fit and held thereon, in adjusted position, by set screws or other appropriate fastening means. In the same way, the palm supporting portion can be adjusted for optimum results to accommodate the particular application of the handle, as well as the physiological differences of the user's hand and arm structure. Thus, the handle can be adjusted to a fit which is comfortable to the user and provides the best mechanical advantage. In the case of a stirrup type handle where a cylindrical sleeve mounting the palm support portion cannot be slipped over the existing handle, the cylindrical sleeve can be made of two longitudinal halves which can be placed over the existing handle and joined together so as to be fixedly attached to the handle in adjusted position thereon.

As will be described hereinafter, the handle of the present invention can be provided in a more advanced design to fit the average hand. Handles of this sort will be made in left hand and right hand versions. In this embodiment, the flat portion which rests against the flat of the palm has a slight twist to add to the comfort of the handle.

With the handle of the present invention, the user can accomplish more work with less wrist/hand fatigue. As the user's forearm begins to fatigue and his hand begins to extend outward while the wrist begins to turn inward, the palm of the user's hand exerts pressure upon the support portion of the handle, reducing further hand extension. This keeps the grip portion of the handle between the proximal interphalangeal joint and the metacarpophalangeal joint, which is the position for the best hook grip possible for the user.

DISCLOSURE OF THE INVENTION

It is an object of the present invention to provide a handle that maintains the user's wrist in either a neutral or a slightly flexed position.

It is an object of the invention to provide a handle that can be adapted to be used with existing handles.

It is an object of the invention to provide adjustment capabilities with respect to the handle of the present invention to accommodate differences in user physiological structure and to accommodate different applications of the handle.

It is an object of the invention to provide a more ergonomic handle.

According to the invention, there is provided a handle which enables the user to achieve a comfortable, natural hook grip, while maintaining the user's wrist in a neutral or flexed position during the performance of gripping, pulling, or lifting movements, found, for example, in a repetitive exercise routine or an extended work routine. The handle facilitates grip strength and endurance.

In its simplest form, the handle comprises a grip portion from which a support surface extends tangentially. The user's palm is engaged by the support surface maintaining the user's wrist in a neutral or flexed position and preventing the hand and wrist from extending due to fatigue or slippage. The handle may be of such construction that it can serve as a handle for both the right hand and the left hand of the user. The handle may have a more sophisticated, ergonomic configuration requiring that it be specifically made in right hand and left hand versions. It is within the scope of the invention to provide a handle wherein the support surface is adjustable with respect to the grip portion to adjust for the application to which the handle is directed and for the physiological characteristics of the user's hand.

DETAILED DESCRIPTION OF THE INVENTION

Figures 1, 2, 3:
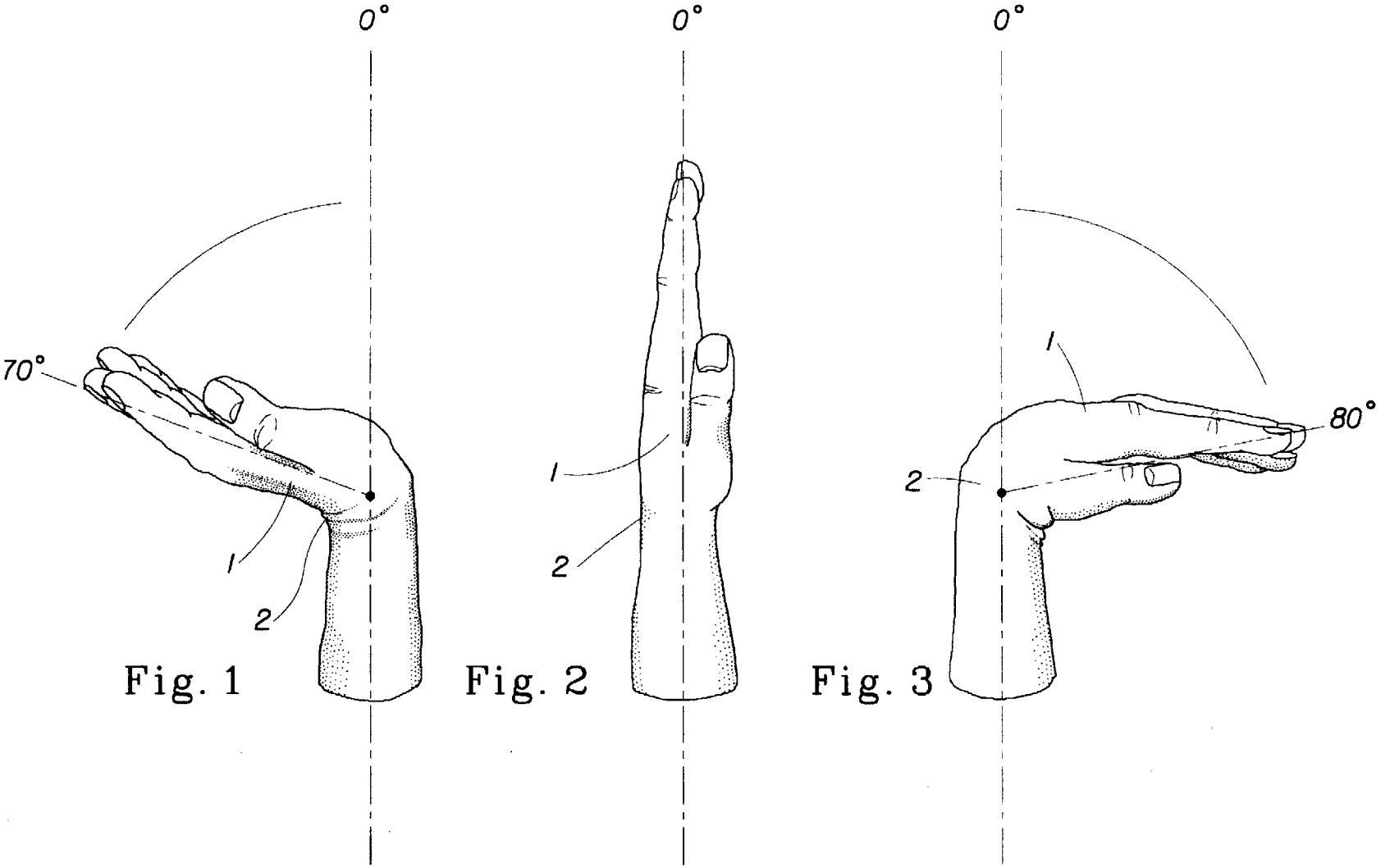
FIG. 1 is a fragmentary side elevational view of a human hand and wrist illustrating the normal maximal range of wrist extension for the average person.
FIG. 2 is a fragmentary elevational view of a human hand and wrist in the neutral position.
FIG. 3 is a fragmentary side elevational view of a human hand and wrist, illustrating the normal maximal range of wrist flexion for the average person.

Reference is first made to FIGS. 1–3, wherein like parts have been given like index numerals. FIGS. 1–3 constitute a series of illustrations depicting the normal range of motion of the wrist for the average person. The range of motion and the manner in which it is depicted in FIGS. 1–3 are the accepted standard of the medical and sports communities.

FIG. 1 specifically depicts a left hand 1 and a wrist 2 in their maximum range of extension of about 70 degrees. FIG. 2 represents the left hand 1 and wrist 2 in a neutral or 0 degree position. FIG. 3 represents the left hand 1 and wrist 2 in their maximum range of flexion of about 80 degrees. FIGS. 1–3 illustrate the range of movement of the hand from substantially maximum extension to substantially maximum flexion so that the purpose of the handle of the present invention and the result of its use can be more fully understood. It will be further understood that the normal range of motion of the right wrist and hand of the average person will be essentially the same.

Figure 4:
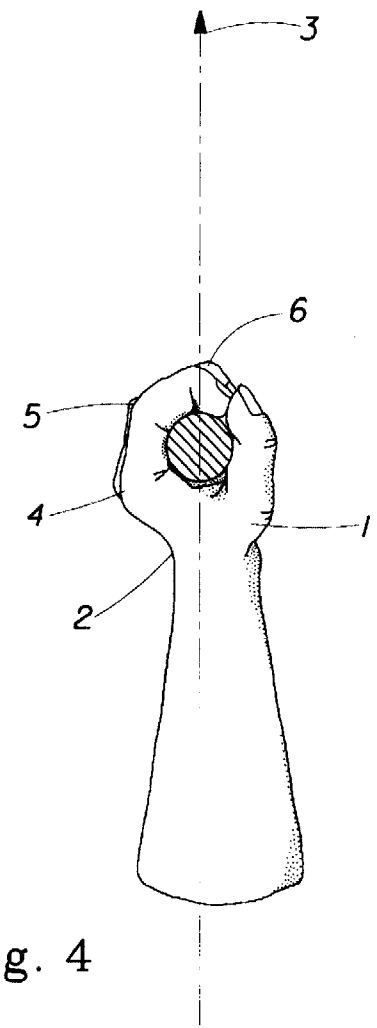
FIG. 4 is a fragmentary side elevational view of a human hand and wrist gripping a handle, the hand and wrist being in an active stage of extension.

FIG. 4 shows the left hand 1 and wrist 2 wherein the left hand is grasping a round handle. The left hand is in the active state of extension. Arrow 3 of FIG. 4 depicts the direction of force or pull, away from hand 1. In FIG. 4, the metacarpophalangeal joint 4, the proximal interphalangeal joint 5, and the distal interphalangeal joint 6 are shown. FIG. 4 further illustrates the orientation of the wrist in an active state of extension. It will be noted that the direction of force 3 pulling away from the grasped hand 1 pulls through the distal interphalangeal joint 6. This is the optimal hand, wrist and arm position for a squeeze-type grip.

Figure 5:
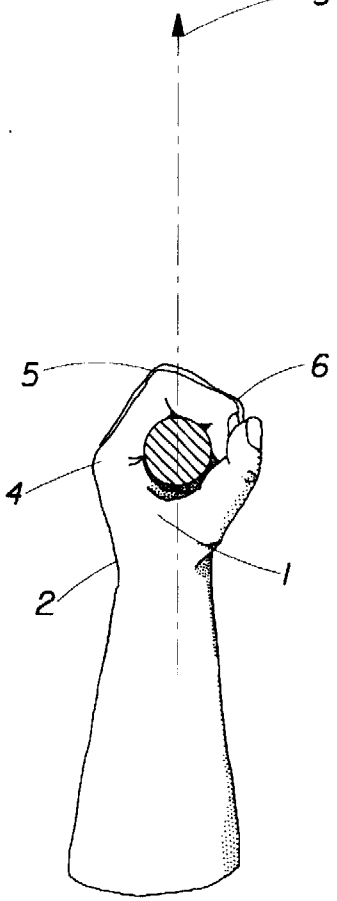
FIG. 5 is a fragmentary side elevational view of a hand and wrist, gripping a handle, the hand and wrist being in a neutral position.

In FIG. 5, the line of force indicated by arrow 3 is pulling between the proximal and distal interphalangeal joint 5 and the wrist 2 is in a neutral position.

Figure 6:
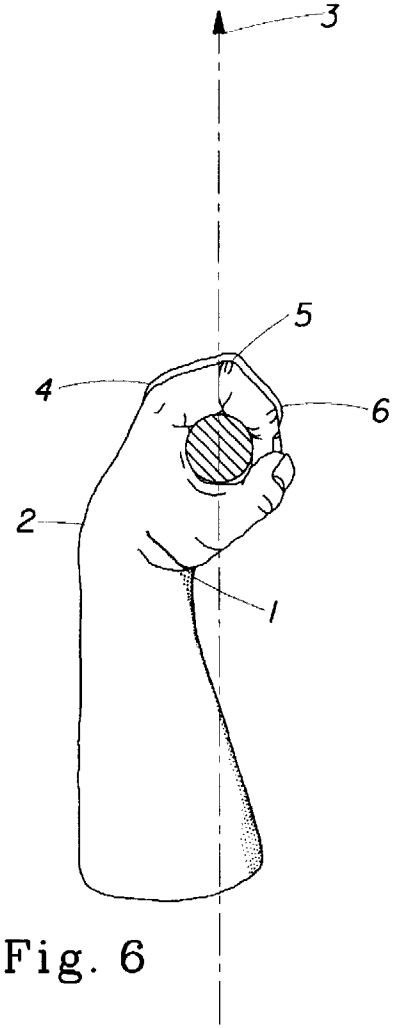
FIG. 6 is a fragmentary side elevational view of a hand and wrist gripping a handle, the hand and wrist being in an active stage of flexion.

In FIG. 6, the line of force is pulling between the proximal interphalangeal joint 5 and the metacarpophalangeal joint 4, while the wrist is in an active state of flexion. This is the optimal hand, wrist and arm position for a hook-type grip to which the present invention is directed.

Figure 8:
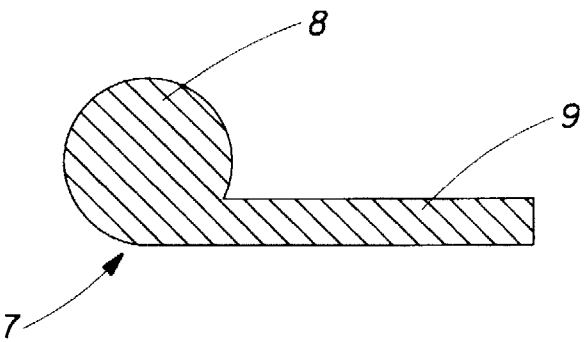
FIG. 8 is a transverse cross-sectional view of the handle of FIG. 7.
Figure 7:
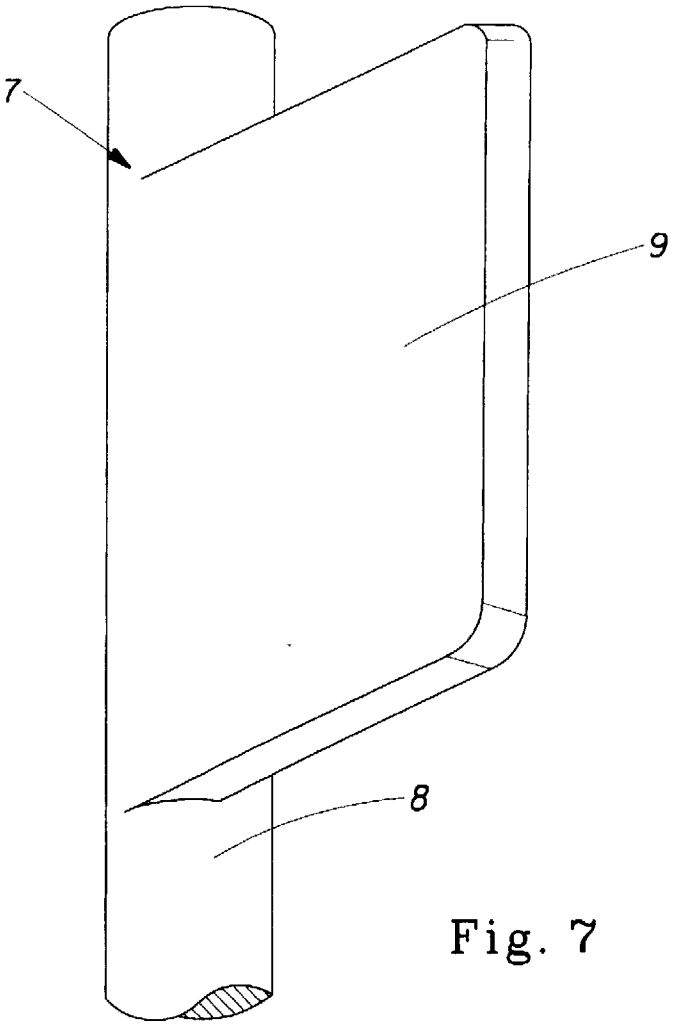
FIG. 7 is a fragmentary prospective view of the handle of a present invention.

FIGS. 7 and 8 depict the handle of the present invention in its simplest form. The handle is generally indicated at 7 and comprises a grip portion 8 and a support portion 9. The grip portion 8 is a cylindrical or round bar-like portion substantially similar to the handles found on prior art exercising devices. The support portion 9 is a flat, planar, plate-like portion which extends tangentially from the peripheral surface of grip portion 8. In an exemplary embodiment, support portion 9 was about 4 inches wide and extended about 3 inches from grip portion 8.

Figure 10:
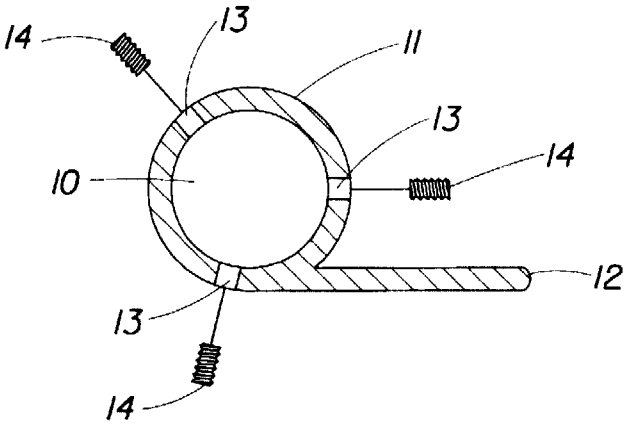
FIG. 10 is an exploded cross-sectional view of the handle of FIG. 9.
Figure 9:
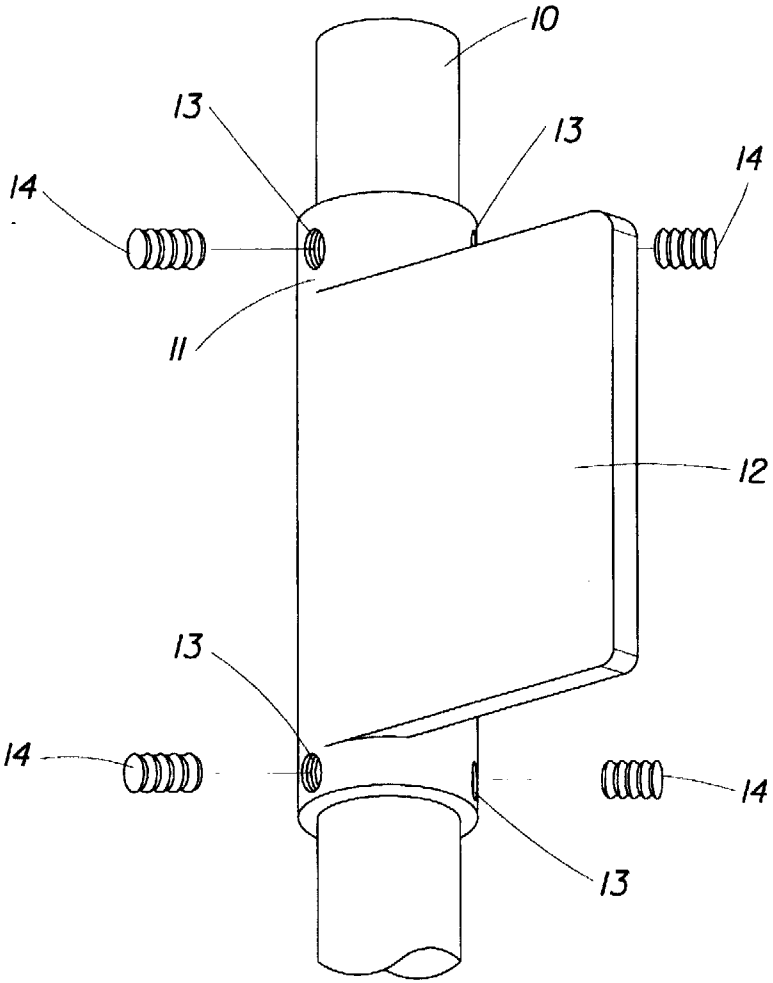
FIG. 9 is an exploded perspective view of another embodiment of the handle of the present invention which may be adjustably affixed to an existing handle element.

Reference is now made to FIGS. 9 and 10. In these Figures a bar-like handle of circular cross-section is shown at 10. Mounted on handle 10 is a cylindrical sleeve 11 having a support member 12. Support member 12 is substantially identical to support portion 9 of FIGS. 7 and 8.

Cylindrical sleeve 11 has an internal diameter substantially equivalent to the external diameter of handle 10 so that sleeve 11 is mounted on handle 10 with a sliding fit. Sleeve 11 is provided with upper and lower sets of 3 evenly spaced, radial, threaded holes 13. The holes 13 are adapted to receive set screws 14, by which the sleeve and support member 11–12 can be affixed to handle 10 in any desired rotative position thereon. The embodiment of FIGS. 9 and 10 accomplish two purposes. First of all, it provides the handle of the present invention with an adjustable support member. Secondly, it illustrates a way in which a conventional handle 10 can be converted to a handle conforming to the teachings of the present invention.

It will be understood that a handle of the type shown in FIGS. 7 and 8 and a handle of the type shown in FIGS. 9 and 10 can serve as either a right or left handle.

Figures 11, 12, 13, 14, 15, 16:
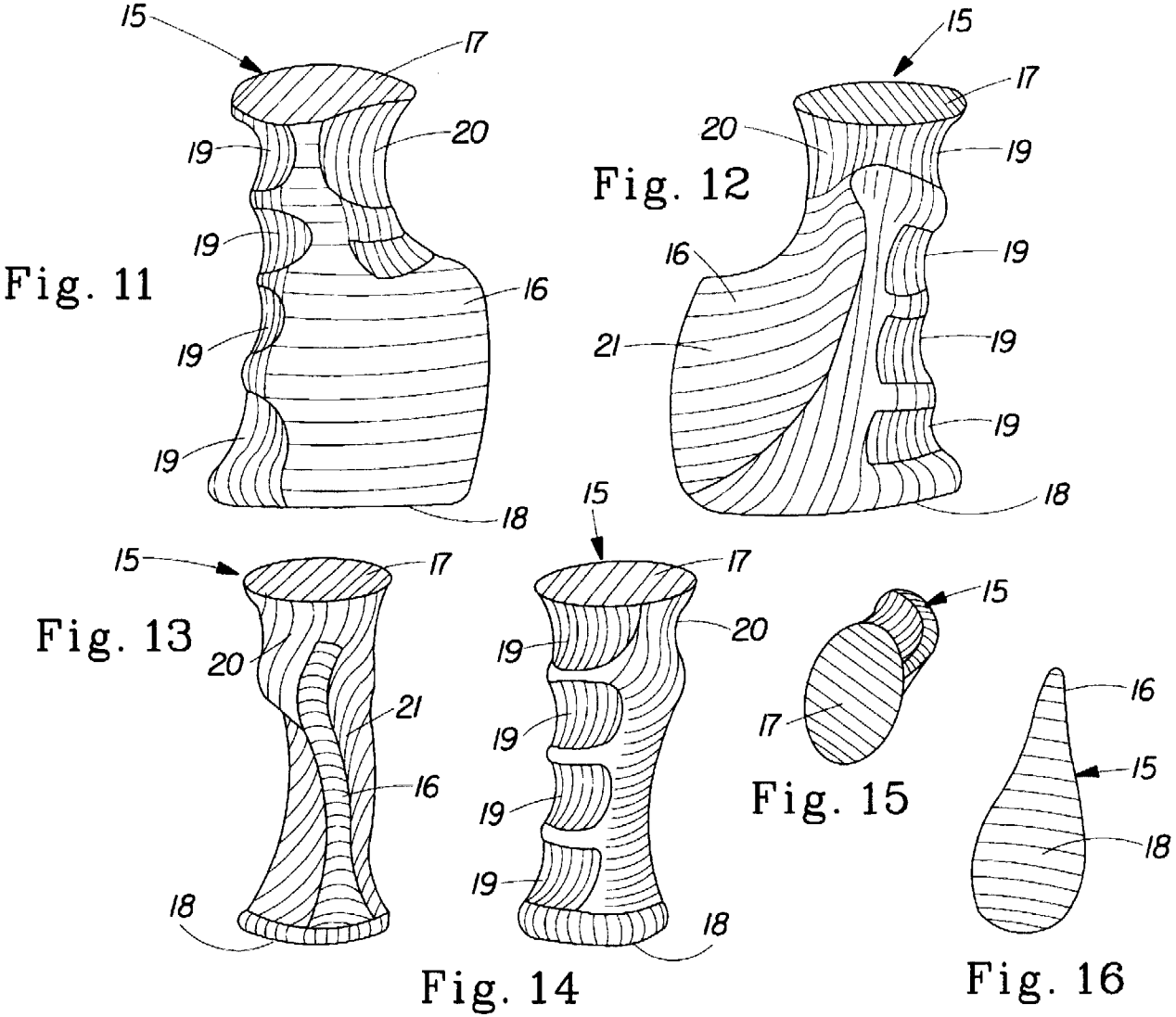
FIG. 11 is a side elevational view of the left side of another embodiment of the handle of the present invention, made specifically for the right hand of the user.
FIG. 12 is a side elevational view of the right side of the handle of FIG. 11.
FIG. 13 is a rear elevational view of the handle of FIG. 11, as seen from the right side of FIG. 11.
FIG. 14 is a front elevational view of the handle of FIG. 11, as seen from the left side of FIG. 11.
FIG. 15 is a top plan view of the handle of FIG. 11.
FIG. 16 is a bottom view of the handle of FIG. 11.

FIGS. 11 through 16 illustrate a more advanced design in which the handle of the present invention is formed to fit the average hand. It will be understood that a handle of the type shown in FIGS. 11 through 16 must be made in right and left hand versions which are essentially mirror images of each other. The handle illustrated in FIGS. 11 through 16 constitutes a handle for the right hand and is generally indicated at 15. In FIG. 11, the support portion of the handle, equivalent to support portion 9 of FIG. 7, is indicated at 16. The top of the handle is indicated at 17 and the bottom of the handle is indicated at 18. Finger indentations are shown at 19, and a thumb indentation is shown at 20. Reference is now made to FIG. 12. It will be noted that throughout FIGS. 11 through 16, like parts have been given like index numerals. FIG. 12 illustrates the right side of the handle for the right hand. In FIG. 12, the surface of support portion 16 is curved as at 21 to fit the thenar eminence of the hand. FIG. 13 illustrates the handle 15 as viewed from the rear and FIG. 14 illustrates handle 15 as viewed from the front. FIG. 15 illustrates the handle viewed from the top, while FIG. 16 illustrates the handle viewed from the bottom.

Figure 18:
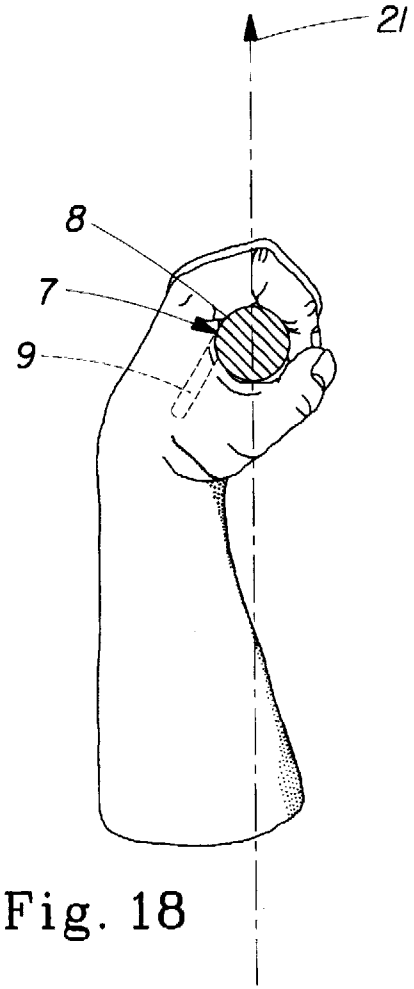
FIG. 18 is a side elevational view of the wrist, hand and handle of FIG. 17.
Figure 17:
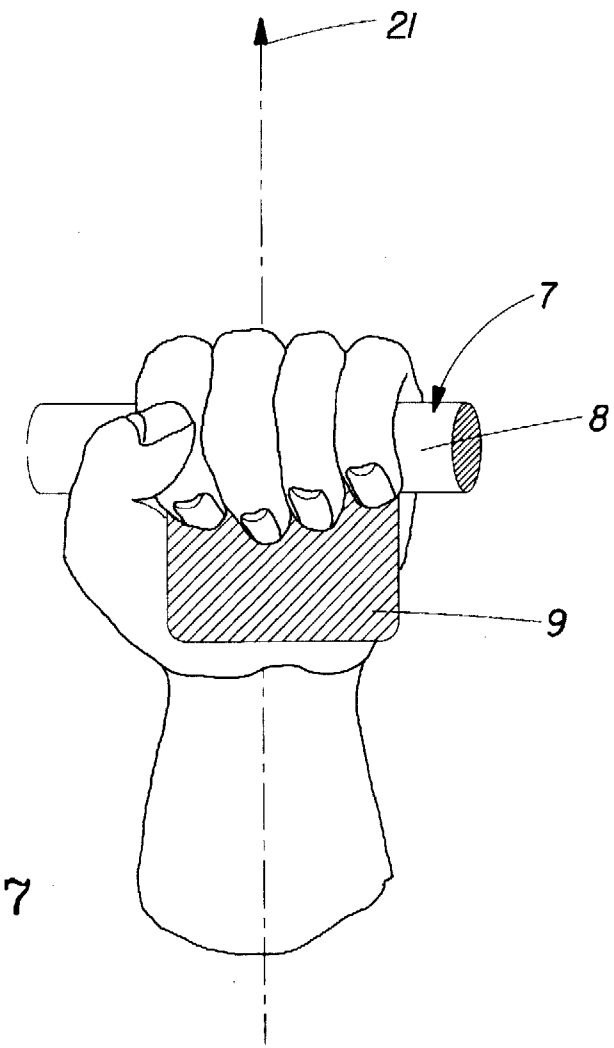
FIG. 17 is a front elevational view illustrating a wrist and a left hand grasping a handle of the type shown in FIGS. 7 and 8.

Reference is now made to FIGS. 17 and 18. These Figures illustrate a left hand grasping a handle of the present invention. For purposes of an exemplary showing, the hand is illustrated as gripping the handle 7 of FIGS. 7 and 8. It will be understood that the handle of FIGS. 9 and 10 and the handle of FIGS. 11 through 16 would be grasped in an essentially identical manner.

In FIGS. 17 and 18, the arrow 21 indicates the direction of pull on the handle 7. The hand is shown in an active state of flexion. The thumb is shown wrapped around grip portion 8. The handle 7 may also be gripped in such a way that the thumb lies on the other side of grip portion 8. This type of grip is illustrated in FIG. 19 to be described hereinafter.

Whether the handle is to be attached to a fixed member, a cable, or a device to be lifted and/or carried, it is important that the attachment means is such that the support portion or support member is properly oriented to maintain the hand in an active state of flexion. The handle assembly 11–12 of FIGS. 9 and 10 could be attached to a chin-up bar or the like by means of the set screws 14. The set screws enable rotational adjustment of the handle assembly on the chin-up bar so that the support member 12 can accomplish its purpose.

Figure 20:
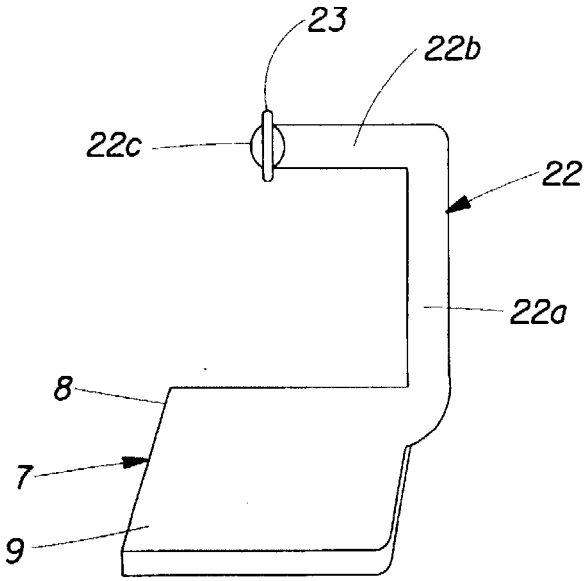
FIG. 20 is an elevational view of the structure of FIG. 19 as seen from the left of FIG. 19.
Figure 19:
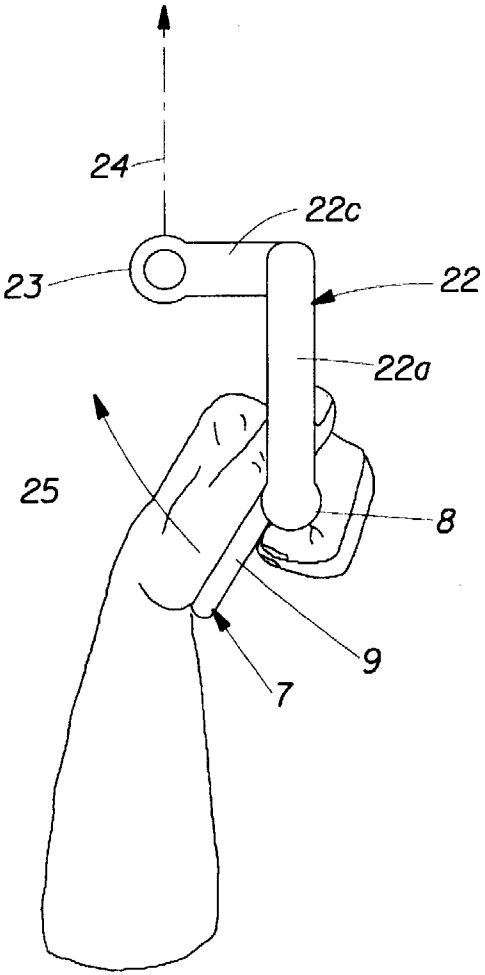
FIG. 19 is a fragmentary top plan view of a mounting system by which the handle of the present invention may be attached to the end of a cable.

FIGS. 19 and 20 illustrate an exemplary handle mounting system in an instance where the handle is to be mounted at the end of a flexible cable. Once again, FIGS. 19 and 20 illustrate the handle 7 of FIGS. 7 and 8 since the handle 7 represents the simplest embodiment of the present invention. It will be understood by one skilled in the art that the handle 15 of FIGS. 11 through 16, for example, could be mounted in the same way.

The handle mounting system is generally indicated at 22. The handle system comprises a first portion 22a which, at one end, is attached to the end of the grip portion 8 of handle 7. The other end of mounting system portion 22a terminates in a second portion 22b which lies in parallel spaced relationship to the grip portion 8 of handle 7, forwardly thereof. The mounting system portion 22b terminates in a third portion 22c which is located forwardly of the hand and extends in a direction perpendicular to mounting system portion 22b. The portion 22c terminates in a cable attachment ring 23. The direction of force on handle 7 and handle mounting system 22 is indicated by arrow 24 in FIG. 19. The force 24 tends to cause handle 7 to move in the direction of arrow 25. This assists in maintaining the active state of flexion. The greater the force at 24, the more handle 7 tends to shift in the direction of arrow 25.

Figure 21:
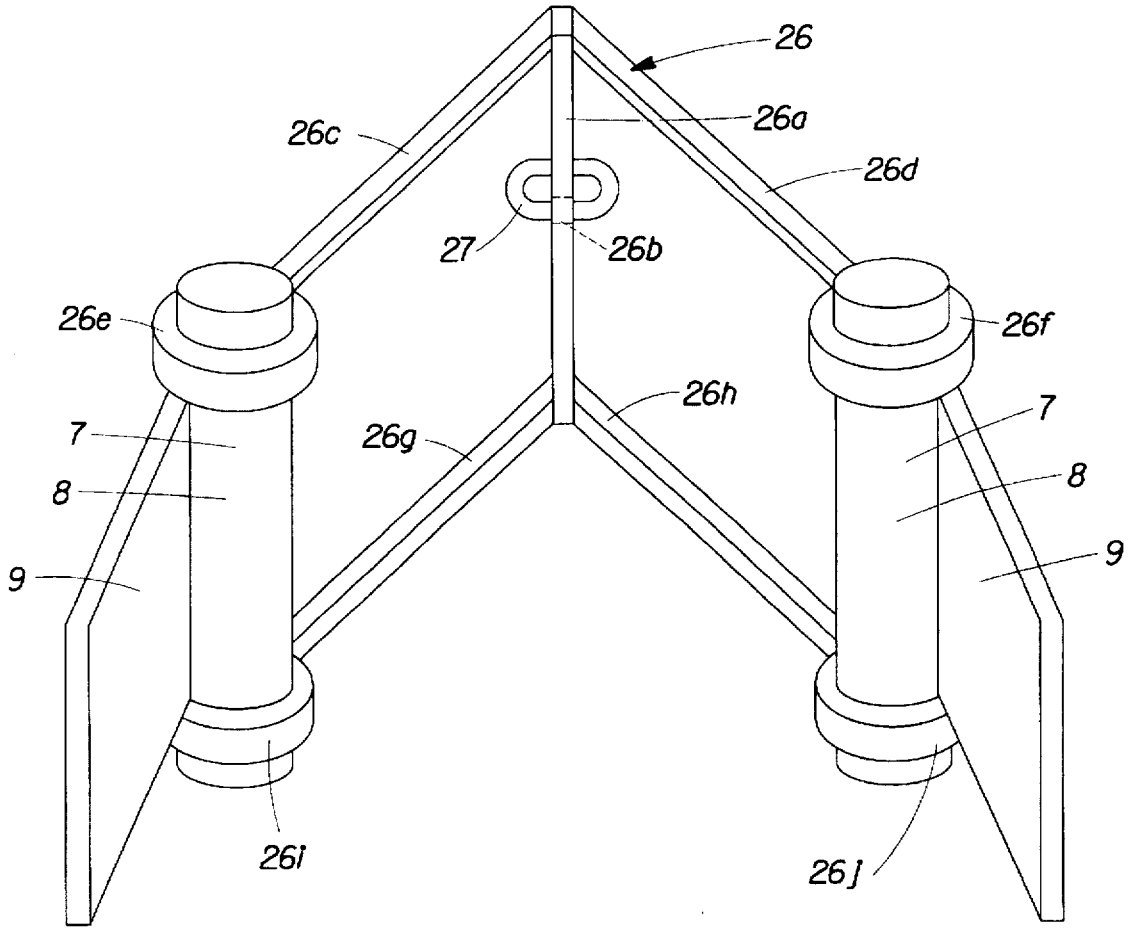
FIG. 21 is a perspective view illustrating a system by which a pair of handles of the present invention can be mounted to a cable for simultaneous grasping by the user's right and left hands.

FIG. 21 illustrates a mounting system, generally indicated at 26, for mounting two handles of the present invention to the end of a single cable. A pair of handles is used, for example, in the above-noted seated cable row exercise, where both hands are employed to pull simultaneously on a single cable. Again, for purposes of an exemplary showing, the handle 7 of FIGS. 7 and 8 is shown in both left and right hand orientations, the handles being identical. It will be understood that other embodiments of the handle of the present invention can be substituted for handle 7, such as the handle 15 of FIGS. 11 through 16. It will be remembered that handle 15 is made in left and right hand versions constituting mirror images of each other.

The dual handle mounting system 26 comprises a framework made up of a forward vertical member 26a. The member 26a has a transverse perforation 26b formed therein through which a cable ring 27 extends. From the upper end of member 26a a pair of laterally and rearwardly extending frame members 26c and 26d extend terminating in circular structures 26e and 26f, respectively. Similarly, at the lower end of frame member 26a an additional pair of frame members 26g and 26h extend laterally and rearwardly, terminating in circular members 26i and 26j. A pair of identical handles 7 are used, having their ends appropriately affixed to circular members 26e–26i, and 26f–26j. The two handles 7 are in parallel spaced relationship and are spaced from each other by an appropriate distance. Excellent results have been achieved when the spacing between handles 7 is about 8 inches.

In an instance where the handle structure of FIG. 21 is a pre-existing handle structure without the support portions 9, the support portions 9 could be added to the grip portions 8 in adjusted positions by providing the support portions 9 with split collars which can be joined together in any appropriate manner.

Figure 22:
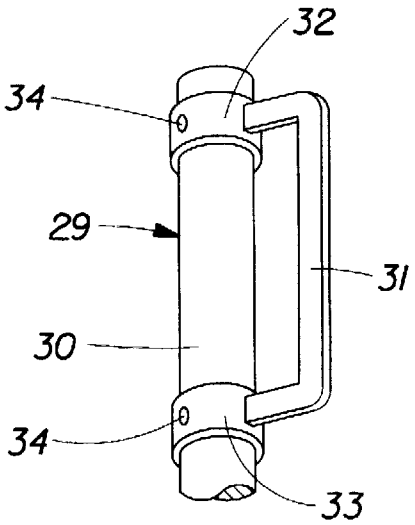

FIGS. 22 through 25 illustrate various modifications of the handle of the present invention. In FIG. 22, the handle is generally indicated at 29 wherein the grip portion comprises a rod-like member 30 of circular cross-section. To the grip portion there is affixed a support portion 31 to support the user's palm. The support portion 31 is a U-shaped portion, the legs of which terminate in cylindrical collars 32 and 33. The collars 32 and 33 are appropriately affixed to the grip portion 30 as by set screws 34, or other appropriate fastening means.

Figure 23:
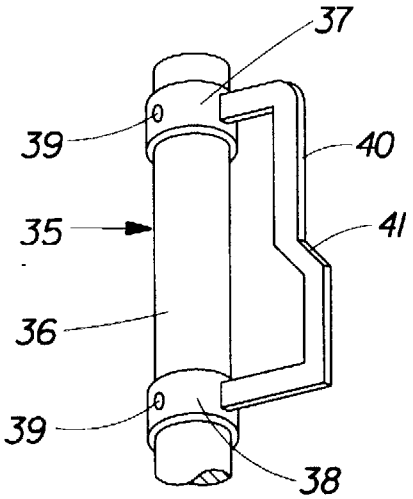

The handle of FIG. 23, generally indicated at 35 comprises a grip portion 36 identical to grip portion 30 to which collars 37 and 38, similar to collars 32 and 33 of FIG. 22, are attached by set screws 39, or the like. The support member 40 is similar to support member 31, having leg portions attached to the collars 37 and 38. That portion of support 40 extending between the support portion legs has a bend 41 formed therein to better fit the user's hand.

The embodiments of FIGS. 22 and 23 enable rotational adjustment of palm portions 31 and 40, respectively, by virtue of set screws 34 and 39. In both embodiments, an opening is defined between grip portions 30 and 36 and support portions 31 or 40, respectively. These openings enable the user to position his thumb in the manner shown in FIG. 18. Alternatively, the user may position his thumb in the manner shown in FIG. 19.

The collars 32 and 33 of FIG. 22 and the collars 37 and 38 of FIG. 23 could be made in two joinable halves for mounting on grip members which have pre-existing support means which preclude sliding of the collars onto the grips (see, for example, FIG. 21). Furthermore, the support members 31 and 40 could be attached tangentially to their respective collars, as is the support member 49 of FIG. 25 to be described hereinafter.

Figure 24:
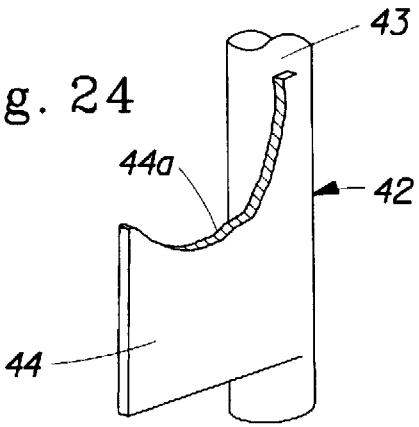
FIGS. 22 through 25 are perspective views illustrating additional embodiments of the handle of the present invention.

The handle embodiment illustrated FIG. 24 is generally indicated at 42 and comprises a bar-like grip 43 having a circular cross-section and a tangentially extending support 44. The support 44 may be affixed to grip 43 in any appropriate manner including flathead machine screws, welding, or the like, or the grip 43 and support 44 may constitute an integral, one-piece casting or molding. The support 44 has a large notch 44a formed therein enabling the user's thumb to more easily achieve a thumb lock position of the type shown in FIG. 17.

Figure 25:
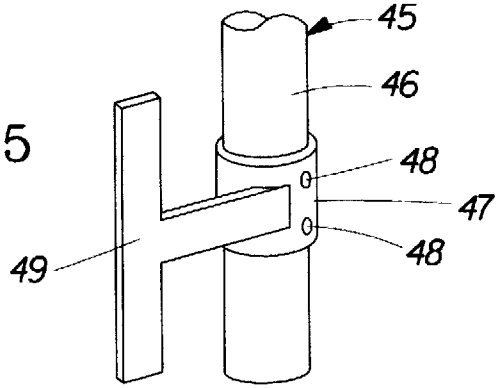

The handle of FIG. 25 is generally indicated at 45 and again is provided with a grip portion 46 in the form of a bar of circular cross-section. Adjustably mounted on grip 46 there is a collar 47 which is held in adjusted rotative position by set screws, two of which are shown at 48. The palm support portion of handle 45 is a T-shaped member 49, the stem of which extends tangentially from collar 47. The collar 47 could be a split collar as described with respect to FIGS. 22 and 23.

FIGS. 23 through 25 are but a sampling of the variations in which the handle of the present invention may be made. The primary features of the handle of the present invention comprise a grip portion and a palm support portion, the palm support portion being oriented in such a way as to maintain the user's arm and hand in a neutral position or an active state of flexion.

Figure 26:
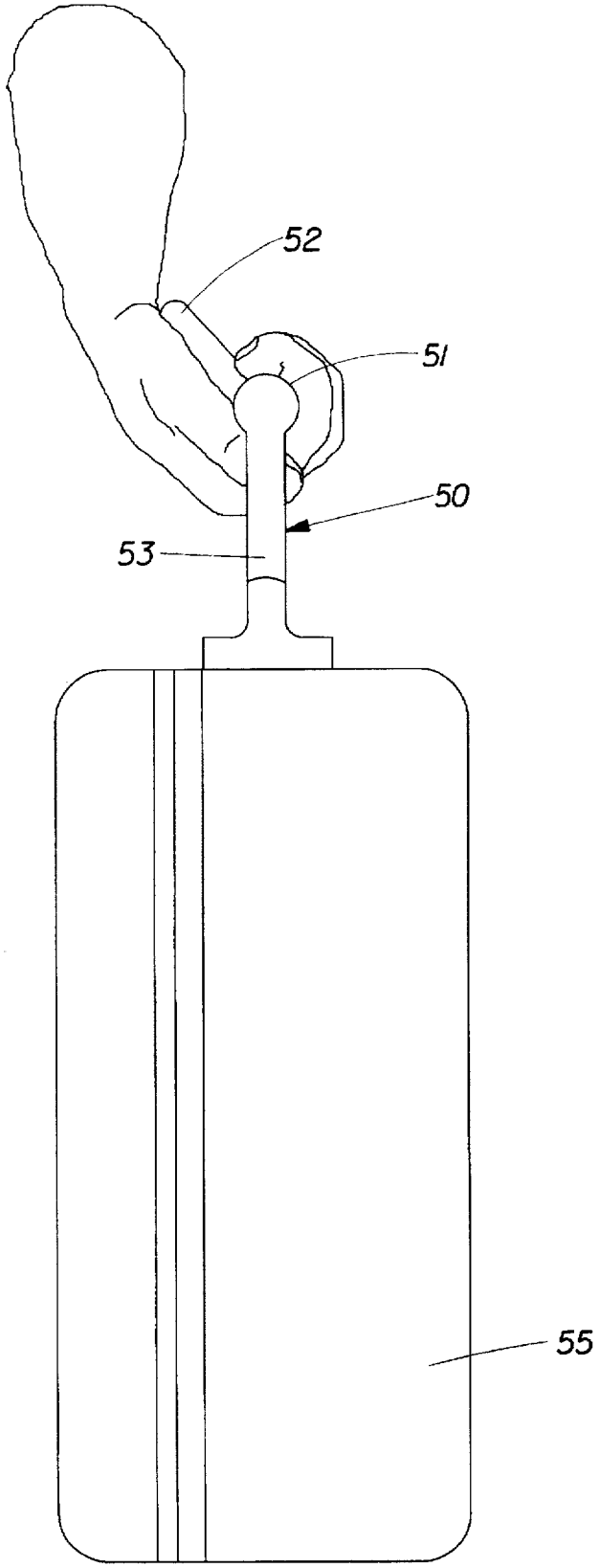
FIG. 26 is a fragmentary elevational view illustrating the handle of the present invention in its application to a suitcase.

FIG. 26 illustrates the handle of the present invention applied to a suitcase. The handle is generally indicated at 50 and is basically of the type shown in FIGS. 7 and 8. To this end, the handle has a grip portion 51 and a palm support portion 52. At the ends of the grip portion, the handle is provided with a pair of downwardly extending legs (one of which is shown at 53 in FIG. 26). The leg 53 and its counterpart at the other end of grip 51 are affixed to the front face 54 of suitcase 55 in such a way that when a lifting force is applied to handle 50, the handle is rigid with respect to suitcase 55, but when a lifting force is no longer applied to the handle, the handle will pivot out of the way and against the face 54 of the suitcase. The handle 50 will allow the carrier to carry the suitcase with greater comfort and for longer periods of time with less wrist and hand fatigue.

Figure 27:
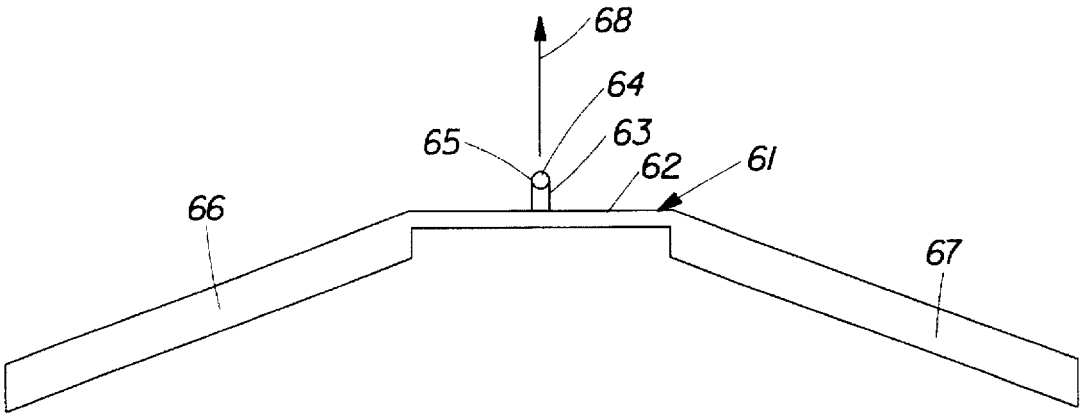
FIG. 27 is an elevational view of a handle assembly for a pull-down type exercise device, employing handles of the type described herein.
Figure 28:
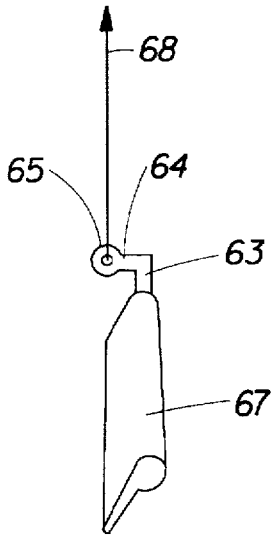
FIG. 28 is an end elevational view of the structure of FIG. 27, as seen from the right of that Figure.

Finally, FIGS. 27 and 28 illustrate a handle, generally indicated at 61 for use with a pull-down exercise device, incorporating the teachings of the present invention. The handle 61 comprises a central bar-like portion 62. From the center of bar 62 a short bar segment 63 extends upwardly. The free end of bar segment 63 terminates in a horizontal portion 64 on which is mounted a cable ring 65. At the ends of bar 62 a pair of handles 66 and 67 of the present invention are mounted. It will be noted that the handles 66 and 67 extend outwardly and slightly downwardly. The pulling force on the handle is indicated in both FIGS. 27 and 28 by arrows 68. Again it will be understood that the handles 66 and 67 will maintain the user's arm and hand in a neutral position or in an active state of flexion.

The present invention having been described in detail, it will be obvious to a person of ordinary skill in the art that a number of variations can be made thereto without departing from the spirit and scope of the invention. The invention should not be construed as being limited to the specific disclosed preferred embodiment or its variations illustrated herein, but rather should be construed as limited only by the claims appended hereto and all reasonable equivalents thereof.

What is claimed:

1. A handle assembly operatively attachable to a movable or fixed device and upon which a user's hand can perform gripping, pulling, and lifting movements, said handle assembly comprising a grip portion and a support portion extending from said grip portion, said grip being shaped to have the user's fingers wrapped thereabout, said support portion being positioned to engage and support substantially the full width of the user's palm and to maintain the user's wrist in one of a neutral and a flexed position to provide a powerful hook-type grip.

2. The handle assembly claimed in claim 1 wherein said support portion of said handle assembly maintains the user's wrist in from about 0° to about 45° of flexion.

3. The handle assembly claimed in claim 1 wherein said support portion of said handle assembly maintains the user's wrist in from about 20° to about 30° of flexion.

4. The handle assembly claimed in claim 1 wherein said grip portion of said handle assembly is a cylindrical member and said support portion of said handle assembly is a planar plate-like member extending from said grip portion.

5. The handle assembly claimed in claim 4 wherein said support portion extends tangentially from said grip portion.

6. The handle assembly claimed in claim 1 wherein said grip portion and said support portion comprise an integral, one-piece structure.

7. The handle assembly claimed in claim 1 wherein handle assembly is suitable for engagement by the left hand and the right hand of the user.

8. The handle assembly claimed in claim 1 wherein said handle assembly includes a right hand version and a left hand version, said right and left hand versions being mirror images of each other, each version being configured to have the user's thumb in opposition to the user's fingers.

9. The handle assembly claimed in claim 1 wherein said support portion is rotatably adjustable about said grip portion.

10. The handle assembly claimed in claim 1 wherein said handle assembly comprises a pre-existing cylindrical grip portion and a separate support portion adjustably affixable to said grip portion.

11. The handle assembly claimed in claim 1 including an attachment means for operatively attaching said handle assembly to said device, said attachment means maintaining said handle assembly support portion properly positioned to cause the users wrist to be in one of a neutral position or a flexed position when the handle assembly is gripped by the user's hand and is subjected to a pulling or lifting force by the user.

12. The handle claimed in claim 1 wherein said handle comprises the handle of an exercise machine.

13. The handle claimed in claim 1 wherein said device comprises an object to be lifted or carried.

14. The handle assembly claimed in claim 11 wherein said attachment means supports two handle assemblies oriented for the user's right and left hands.

15. A handle assembly operatively attachable to a movable or fixed device and upon which a user's hand can perform gripping, pulling, and lifting movements, said handle assembly comprising a grip portion and a support portion extending from said grip portion, said grip being shaped to have the user's fingers wrapped thereabout, said support portion being positioned to engage and support substantially the full width of the user's palm and to maintain the user's wrist in either one of a neutral and a flexed position to provide a powerful hook-type grip, said handle assembly comprising a pre-existing cylindrical grip portion and a separate support portion adjustably affixable to said grip portion, collars affixed to said support portion, said collars being adjustably mounted on said grip portion.

16. The handle assembly claimed in claim 15 wherein each of said collars is made up of two parts joinable together by fastening means.

17. A handle assembly operatively attachable to a movable or fixed device and upon which a user's hand can perform gripping, pulling, and lifting movements, said handle assembly comprising a grip portion and a support portion extending from said grip portion, said grip being shaped to have the user's fingers wrapped thereabout, said support portion being positioned to engage and support substantially the full width of the user's palm and to maintain the user's wrist in either one of a neutral and a flexed position to provide a powerful hook-type grip, said handle assembly comprising a pre-existing cylindrical grip portion and a separate support portion adjustably affixed to the grip portion, a cylindrical sleeve affixed to said support portion, said sleeve being mountable on said pre-existing grip with a sliding fit and adjustably affixed thereon by fastening means.

* * * * *